US007509693B1

(12) United States Patent
Graves et al.

(10) Patent No.: US 7,509,693 B1
(45) Date of Patent: Mar. 31, 2009

(54) TOILET CLEANING APPARATUS

(76) Inventors: Bernard S. Graves, 2110 Island Dr., Miramar, FL (US) 33023; Kimberly Graves, 2110 Island Dr., Miramar, FL (US) 33023

( * ) Notice: Subject to any disclaimer, the term of this patent is extended or adjusted under 35 U.S.C. 154(b) by 0 days.

(21) Appl. No.: 12/144,941

(22) Filed: Jun. 24, 2008

(51) Int. Cl.
*A47K 13/00* (2006.01)

(52) U.S. Cl. ..... 4/233

(58) Field of Classification Search ..... 4/233
See application file for complete search history.

(56) References Cited

U.S. PATENT DOCUMENTS

| | | | | |
|---|---|---|---|---|
| 3,837,018 | A * | 9/1974 | Haberle | 4/233 |
| 4,063,316 | A | 12/1977 | Hunninghaus | |
| 4,713,845 | A * | 12/1987 | Bono | 4/233 |
| 4,745,639 | A | 5/1988 | Wileman, III | |
| 5,022,097 | A | 6/1991 | Pusic | |
| 5,119,517 | A | 6/1992 | Chang | |
| 5,504,946 | A * | 4/1996 | Keshiro | 4/233 |
| 5,806,105 | A | 9/1998 | Yu | |
| 6,003,159 | A | 12/1999 | Sadegh et al. | |
| 6,772,451 | B2 | 8/2004 | Pellati | |
| 7,028,346 | B2 | 4/2006 | Ermini | |
| 2004/0040075 | A1 * | 3/2004 | Blatz et al. | 4/233 |

* cited by examiner

*Primary Examiner*—Charles E Phillips
(74) *Attorney, Agent, or Firm*—Crossley Patent Law; Mark A. Crossley

(57) ABSTRACT

The toilet cleaning apparatus provides for hinged fit to an existing toilet with rim. The seat of the apparatus has a top, a bottom, and a cavity therebetween. The motor with pulleys and belt is disposed within the cavity. A movable cleaning pad disposed outside of the cavity between the seat bottom and toilet rim is attached to the motor via the drive attachment. The apparatus provides an electric power source in communication with the motor and the seat lift and lowering pivot drive, and a pair of pedals for controlling the power source whereby the seat is selectively lifted and lowered and the seat bottom and rim are selectively wiped by the cleaning pad, with the seat in the down position.

2 Claims, 4 Drawing Sheets

TOILET CLEANING APPARATUS

BACKGROUND OF THE INVENTION

The need for sanitation of toilets, especially public toilets, is a common problem. Various devices have been proposed to aid in cleaning and sanitizing toilets between uses. Most of the various cleaning devices and even complete toilets are quite complex and, therefore, significantly expensive. Further, water spray and spills are typically involved, and drying devices are often coupled with them. What is needed is an apparatus which allows lid lifting without human touch along with cleaning capabilities. What is further needed is an apparatus which can clean the seat bottom and the rim of the toilet bowl itself, areas where janitorial duties are seldom pleasant, and areas typically contaminated with splatter. The present apparatus provides attachments, which are fitted to an existing toilet and provides automated seat bottom and rim cleaning and also provides automated seat lift and lowering.

FIELD OF THE INVENTION

The toilet cleaning apparatus relates to toilets and more especially to a toilet seat apparatus with automated cleaning of the underside of a toilet seat and the rim of a toilet bowl, and automated seat lift and lowering.

SUMMARY OF THE INVENTION

The general purpose of the toilet cleaning apparatus, described subsequently in greater detail, is to provide a toilet cleaning apparatus which has many novel features that result in an improved toilet cleaning apparatus which is not anticipated, rendered obvious, suggested, or even implied by prior art, either alone or in combination thereof.

To attain this, the toilet cleaning apparatus provides automated, human touch-free cleaning of the bottom of the seat, the toilet rim, or both, tasks which are typically unpleasant to almost any individual. The cleaning is provided in reciprocating movement, enabling better results. The apparatus offers a cost effective solution to these cleaning issues. The apparatus also provides automated seat lift and lowering, free from human touch. The apparatus is easily fitted to virtually any toilet. The low profile of the apparatus enables the use of the existing toilet lid and all other toilet components.

Thus has been broadly outlined the more important features of the improved toilet cleaning apparatus so that the detailed description thereof that follows may be better understood and in order that the present contribution to the art may be better appreciated.

An object of the toilet cleaning apparatus is to provide for lifting a toilet seat without human touch.

A further object of the toilet cleaning apparatus is to clean the bottom of a seat and the toilet rim without human touch.

An added object of the toilet cleaning apparatus is to clean without water sprays and air drying.

And, an object of the toilet cleaning apparatus is to minimize complexity and expense.

Yet another object of the toilet cleaning apparatus is to provide for use on existing toilets.

These together with additional objects, features and advantages of the improved toilet cleaning apparatus will be readily apparent to those of ordinary skill in the art upon reading the following detailed description of presently preferred, but nonetheless illustrative, embodiments of the improved toilet cleaning apparatus when taken in conjunction with the accompanying drawings.

In this respect, before explaining the current embodiments of the improved toilet cleaning apparatus in detail, it is to be understood that the toilet cleaning apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved toilet cleaning apparatus. It is therefore important that the claims be regarded as including such equivalent constructions insofar as they do not depart from the spirit and scope of the toilet cleaning apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 8 thereof, the principles and concepts of the toilet cleaning apparatus generally designated by the reference number 10 will be described.

Figure 1:
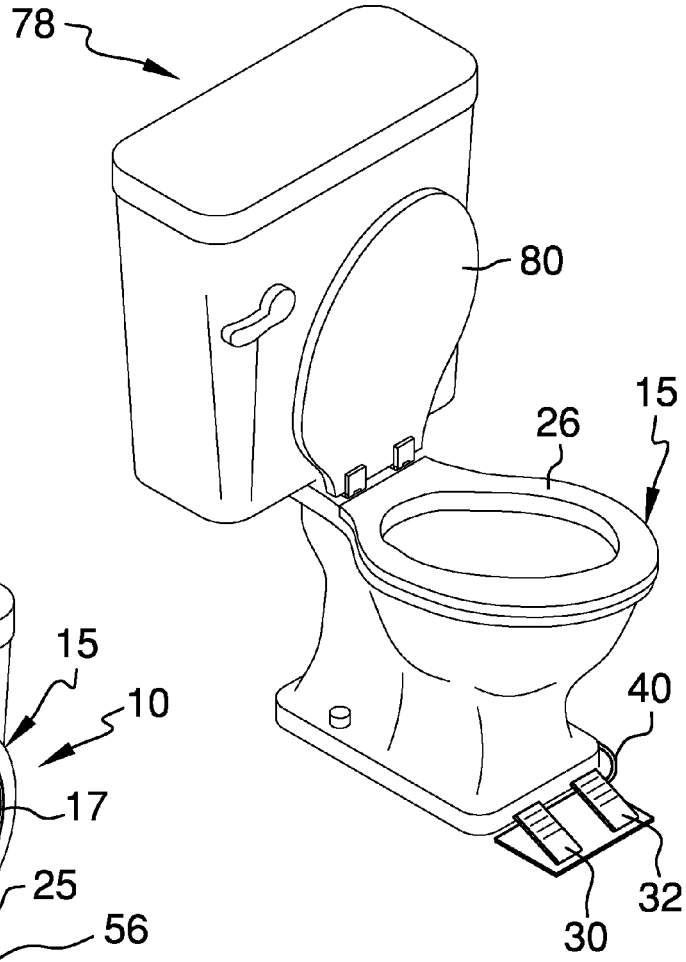
FIG. 1 is a perspective view of the apparatus installed on a toilet, with seat down.
Figure 2:
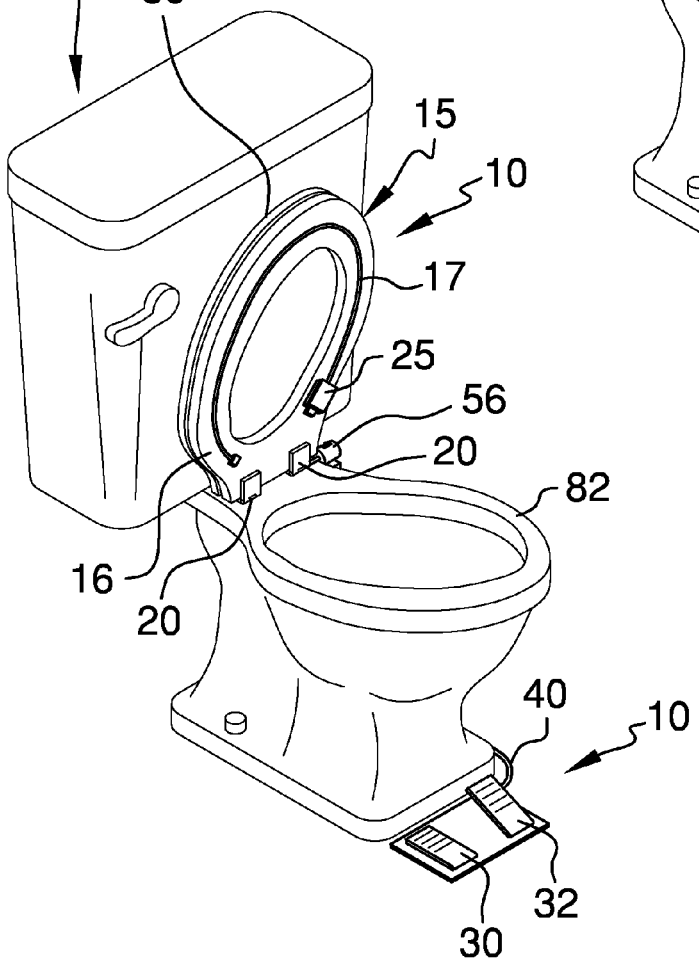
FIG. 2 is a perspective view of the apparatus installed on a toilet, with seat up.
Figure 3:
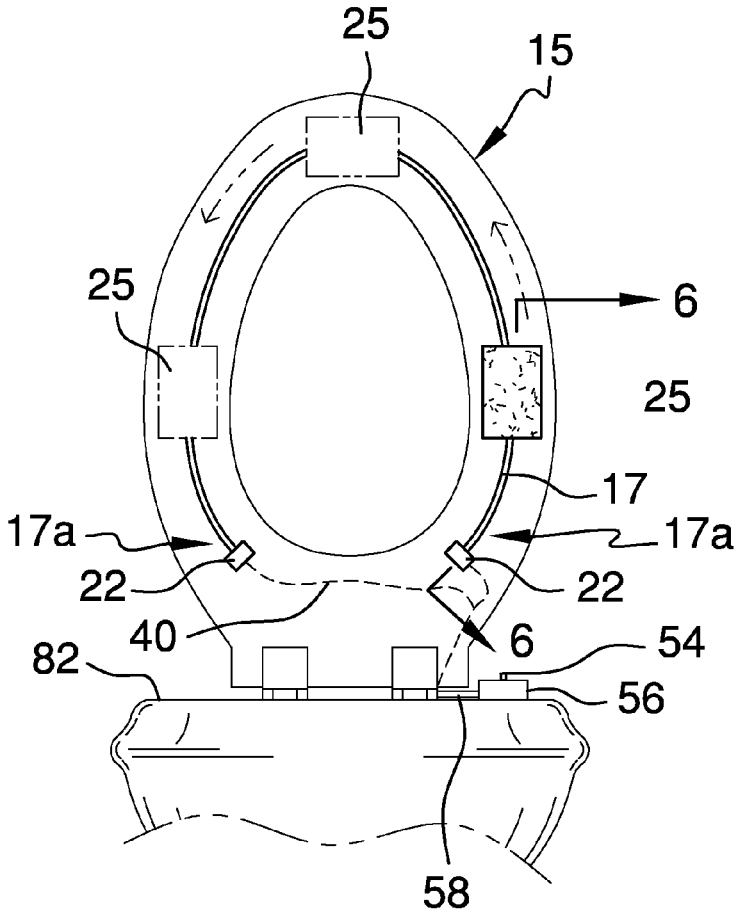
FIG. 3 is a front elevation view of the installed apparatus, with seat up.
Figure 4:
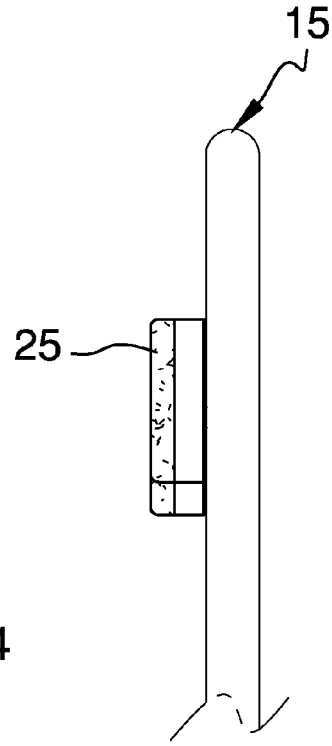
FIG. 4 is a side elevation view of the seat with cleaning pad.
Figure 5:
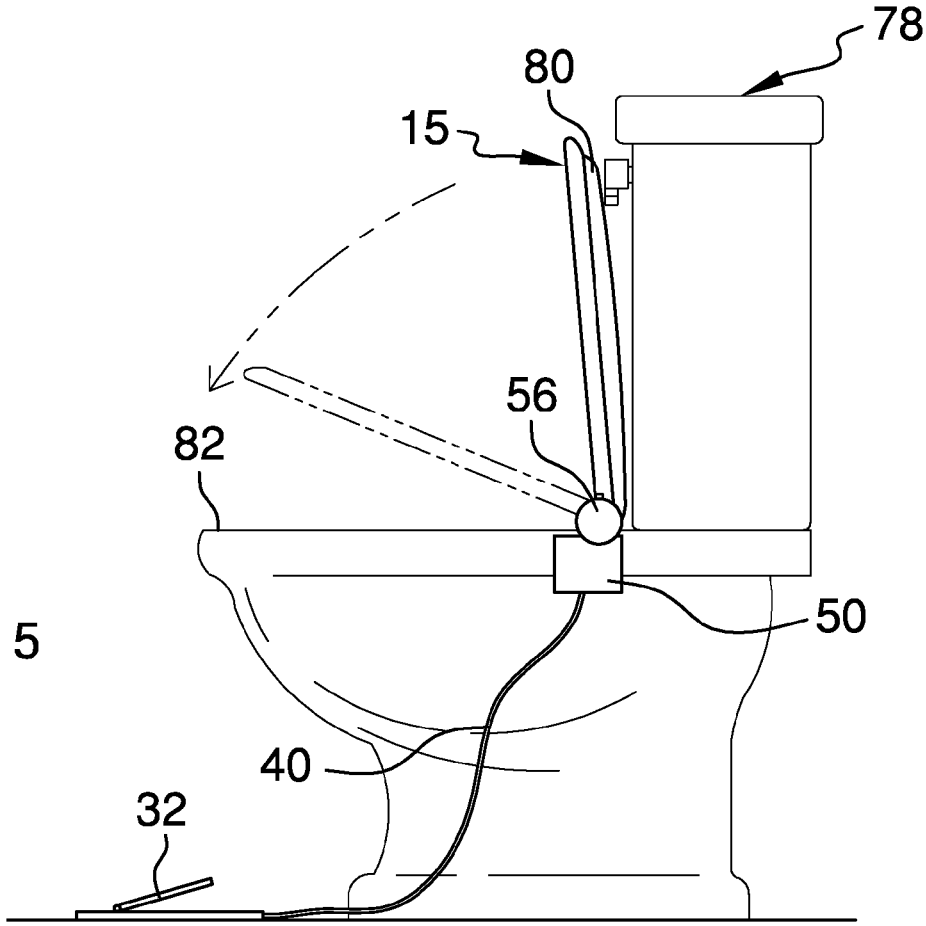
FIG. 5 is a side elevation view of the installed apparatus.
Figure 6:
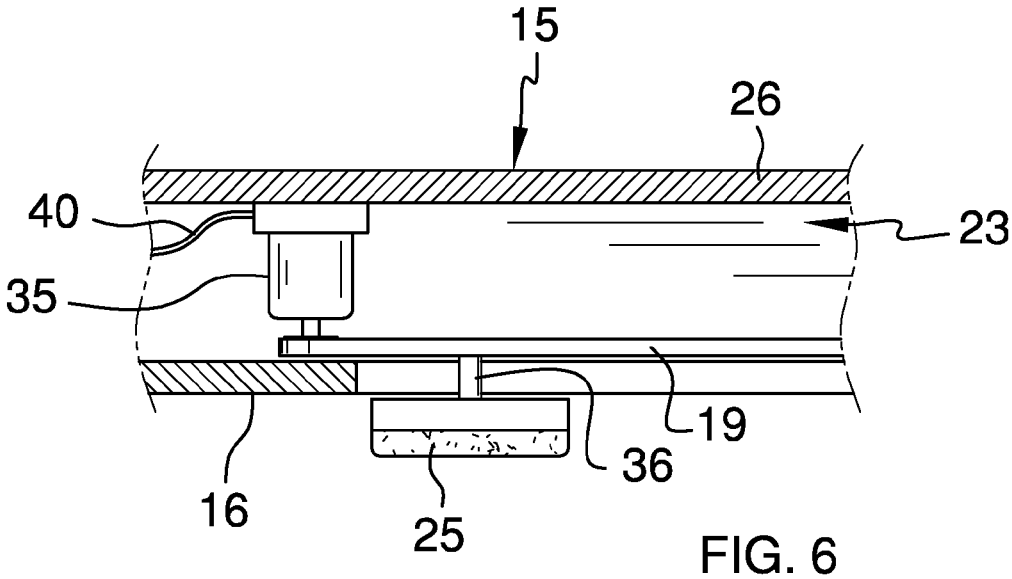
FIG. 6 is a partial cross sectional view of FIG. 3.
Figure 7:
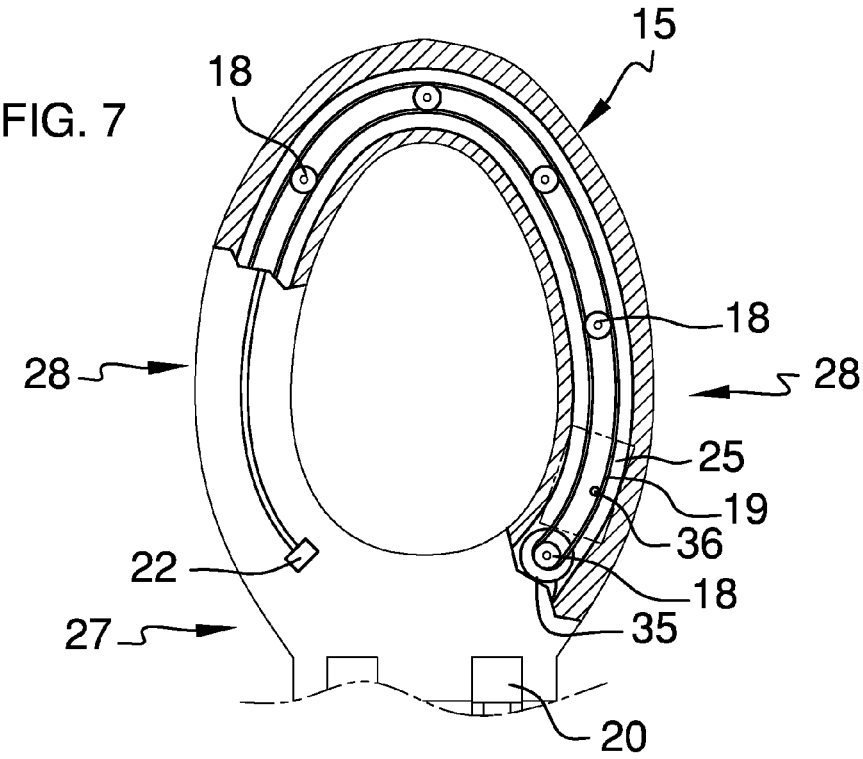
FIG. 7 is a bottom, partial cross sectional view of the seat.
Figure 8:
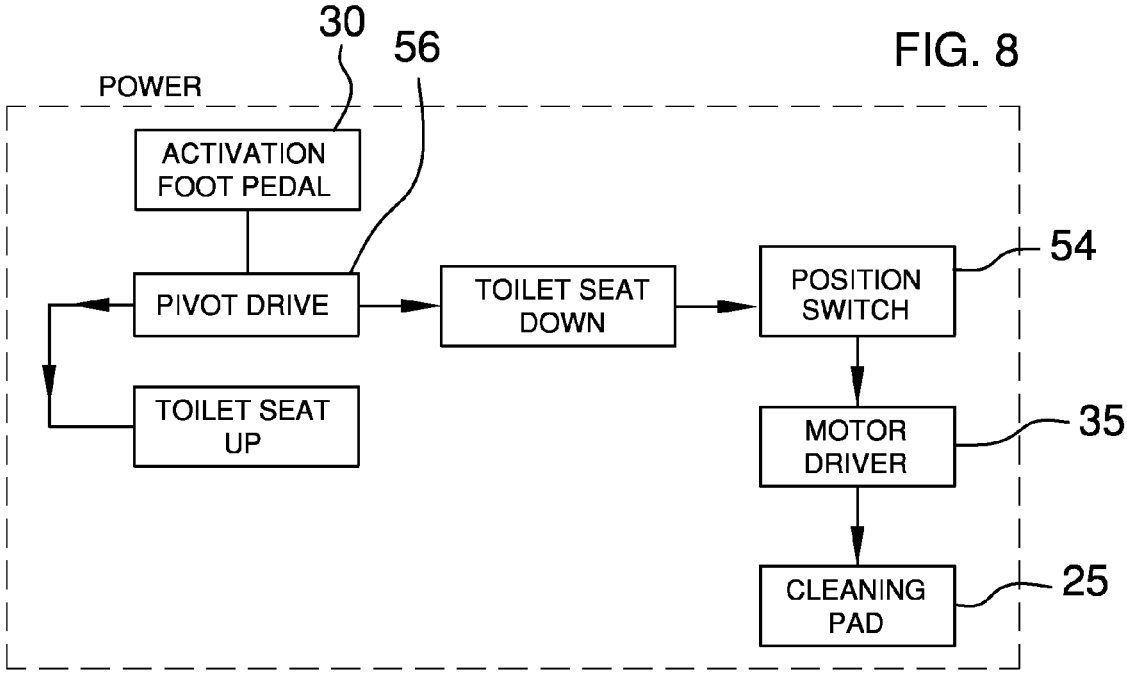
FIG. 8 is a schematic block diagram of steps of apparatus activation.

Referring to FIGS. 1 and 2, the toilet cleaning apparatus 10 provides for hinged fit to an existing toilet 78, and, importantly, without any alterations to the toilet 78 or surrounding spaces or equipment. Even the original seat hinges 20 may be used or are provided with the apparatus 10. The apparatus 10 seat 15 installs via hinges 20, between the existing lid 80 and rim 82. The first pedal 30 operates seat 15 lift and lowering via the pivot drive 56. Of further importance is that the first pedal 30 and second pedal 32 are selectively placed and not restricted as to relative position, to themselves or the toilet 78.

Referring to FIGS. 3-8, the apparatus 10 comprises the substantially oval seat 15 having a top 26, a bottom 16, a cavity 23 therebetween, a pair of opposed sides 28, and a back 27. The motor 35 with pulley 18 and plurality of spaced apart pulleys 18 are disposed within the cavity 23. Each pulley 18 is in communication via the continuous loop belt 19. The guide track 17 with ends **17*a* is disposed within the bottom 16 of the seat 15. The guide track 17 has a stop 22 disposed at each end 17*a* at the back 27 on opposite sides 28 of the seat 15. Discontinuation of guide track 17, the motor 35, pulleys 18 and related components at the seat 15 back 27 is important as it allows for a low profile, standardized fit of the seat 15 on a toilet 78, and enables retention of the original lid 80. The drive attachment 36 is movably disposed within the guide track 17. The drive attachment 36 is attached to and propelled by the belt 19 and reciprocatingly moves between the stops 22. The stops 22 are in communication with the motor 35 whereby the drive attachment 36 reaching a stop 22 causes the motor 35 to cease running. The next cycle of movement of the motor 35 is initiated by the second pedal 32 and reverses the previous path of the drive attachment 36 to return to the opposite stop 22. The cleaning pad 25 is disposed between the seat 15 bottom 16 and the rim 82 of the toilet 78. The cleaning pad 25 is affixed to the drive attachment 36. The cleaning pad 25 is provided in a number of embodiments and is not limited to a sponge, brush, or any other useful device for seat 15 and rim 82 contact and cleaning. The cleaning pad 25 is optionally impregnated with various cleansing agents. The means for automated seat 15 lift and lowering comprises the pivot drive 56 disposed proximal to and in communication with the seat 15 back 27 via the axle 58. Of importance is that the pivot drive 56 is compact, visually and physically unobtrusive, and sealed. The size of the pivot drive 56 provides for fit either under or beside the seat 15. The pivot drive 56 further comprises the position switch 54. The position switch 54 senses a closed or open position of the seat 15 relative to the rim 82. The power source 50 is disposed adjacent to the pivot drive 56. The power source 50 is provided in more than one type which includes but is not limited to battery and wall outlet power. The power source 50 is in communication with the motor 35 and the pivot drive 56. The means for selectively controlling the power source 50 comprises the first pedal 30 and the second pedal 32. The first pedal 30 controls the seat 15 lift and lowering. The second pedal 32 controls the motor 35. Various communications between the power source 50, the motor 35, the stops 22, the pivot drive 56, and the fist pedal 30 and second pedal 32 are provided via connections 40. The second pedal 32 is in communication with the position switch 54 of the pivot drive 56 whereby the motor 35 is operable in a down position of the seat 15, which depresses the vertically oriented position switch 54. This operational function provides two advantages. First, the seat 15 cleaning components are inoperable and are moved out of the way when the seat 15 is in the up position, and are thereby significantly isolated from splatter that is common in male urination. Second, the pad 25 is capable of cleaning both the seat 15 bottom 16 and rim 82 with the seat 15** in the down position.

With respect to the above description then, it is to be realized that the optimum dimensional relationships for the parts of the toilet cleaning apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the toilet cleaning apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the toilet cleaning apparatus may be used.

Therefore, the foregoing is considered as illustrative only of the principles of the toilet cleaning apparatus. Further, since numerous modifications and changes will readily occur to those skilled in the art, it is not desired to limit the toilet cleaning apparatus to the exact construction and operation shown and described, and accordingly, all suitable modifications and equivalents may be resorted to, falling within the scope of the toilet cleaning apparatus.

What is claimed is:

1. A toilet cleaning apparatus, comprising, in combination:

a substantially oval toilet seat having a top, a bottom, a cavity therebetween, a pair of opposed sides, a back, the seat hingedly fitted to a rim of an existing toilet;

a motor means within the cavity, comprising:

a motor with pulley;

a plurality of spaced apart pulleys;

a continuous loop belt providing communication between the pulleys;

a guide track disposed within the bottom of the seat, the guide track having a pair of spaced apart ends, each end at one side of the back of the seat, respectively;

a pair of spaced apart stops, each stop disposed at one end of the guide track, respectively;

a drive attachment movably disposed within the guide track, the drive attachment affixed to the belt whereby the drive attachment is propelled by the belt, the drive attachment reciprocatingly moved between the stops, the drive attachment traversed between each stop with motor initiation;

a cleaning pad attached to the drive attachment, the pad disposed between the seat bottom and the rim, wherein the pad is in contact with the seat bottom and the rim with the seat in a down position;

a power source for the motor, the power source disposed adjacent to the seat;

a vertically disposed position switch in communication with the motor, the switch depressed with the seat in the down position;

a pedal for motor initiation, the pedal in communication with the motor with the switch depressed.

2. A toilet cleaning apparatus, comprising, in combination:

a substantially oval toilet seat having a top, a bottom, a cavity therebetween, a pair of opposed sides, a back, the seat hingedly fitted to a rim of an existing toilet;

a motor means within the cavity, comprising:

a motor with pulley;

a plurality of spaced apart pulleys;

a continuous loop belt providing communication between the pulleys;

a guide track disposed within the bottom of the seat, the guide track having a pair of spaced apart ends, each end at one side of the back of the seat, respectively;

a pair of spaced apart stops, each stop disposed at one end of the guide track, respectively;

a drive attachment movably disposed within the guide track, the drive attachment affixed to the belt whereby the drive attachment is propelled by the belt, the drive attachment reciprocatingly moved between the stops, the drive attachment traversed between each stop with motor initiation;

a cleaning pad attached to the drive attachment, the pad disposed between the seat bottom and the rim, wherein the pad is in contact with the seat bottom and the rim with the seat in a down position;

a pivot drive for automated seat lift and lowering, the drive disposed proximal to and in communication with the seat back via an axle;

a vertically disposed position switch within the pivot drive, the switch depressed with the seat in the down position;

a selectively disposed first pedal for selective control of the pivot drive;

a selectively disposed second pedal for motor initiation, the second peal in communication with the motor with the position switch depressed;

a power source for the motor and the pivot drive, the power source disposed adjacent to the seat.

* * * * *